US007029333B2

(12) United States Patent
Shimizu et al.

(10) Patent No.: US 7,029,333 B2
(45) Date of Patent: Apr. 18, 2006

(54) ELECTRICAL CONNECTOR FOR BOARDS AND METHOD OF MAKING

(75) Inventors: Kazuomi Shimizu, Aichi (JP); Yoichi Murakami, Aichi (JP); Hiroaki Hisanaga, Okayama (JP)

(73) Assignee: J.S.T.Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/500,860

(22) PCT Filed: Nov. 21, 2003

(86) PCT No.: PCT/JP03/14899

§ 371 (c)(1),
(2), (4) Date: Jul. 19, 2004

(87) PCT Pub. No.: WO2004/049520

PCT Pub. Date: Jun. 10, 2004

(65) Prior Publication Data

US 2005/0079742 A1 Apr. 14, 2005

(30) Foreign Application Priority Data

Nov. 26, 2002 (JP) ..... 2002-342765

(51) Int. Cl.
*H01R 24/00* (2006.01)
*H01R 33/00* (2006.01)

(52) U.S. Cl. ..... 439/660; 439/636

(58) Field of Classification Search ..... 439/660, 439/74, 736; 29/876, 883
See application file for complete search history.

(56) References Cited

U.S. PATENT DOCUMENTS

| | | | | | |
|---|---|---|---|---|---|
| 3,697,933 | A | * | 10/1972 | Black et al. | 439/686 |
| 3,966,290 | A | * | 6/1976 | Little et al. | 439/74 |
| 5,772,474 | A | * | 6/1998 | Yagi et al. | 439/660 |
| 5,779,505 | A | * | 7/1998 | Yagi et al. | 439/736 |
| 5,842,874 | A | * | 12/1998 | Yagi et al. | 439/74 |
| 6,010,370 | A | * | 1/2000 | Aihara et al. | 439/660 |
| 6,155,886 | A | * | 12/2000 | Koseki et al. | 439/736 |
| 6,159,021 | A | * | 12/2000 | Kusuhara | 439/74 |

FOREIGN PATENT DOCUMENTS

| | | |
|---|---|---|
| JP | 10-284197 | 10/1998 |
| JP | 11-67364 | 3/1999 |
| JP | 11-105043 | 4/1999 |
| JP | 2001-1372 | 1/2001 |

* cited by examiner

*Primary Examiner*—Hae Moon Hyeon
(74) *Attorney, Agent, or Firm*—Oblon, Spivak, McClelland, Maier & Neustadt, P.C.

(57) ABSTRACT

A housing made of an insulating synthetic resin has a connecting recess opened in the connecting direction. The side walls defining the connecting recess is provided with terminal retainer recesses arranged side by side in the lateral direction. The openings are formed in the portion of the outer side surface of each side wall which correspond to the partition walls separating adjacent terminal retainer recesses from each other. The openings have the terminal retainer holes, which are formed on both sides of the corresponding partition walls, opened to the exterior thereof. When the housing is molded, the pins for forming the openings are interposed among the ribs of the metal mold which are used to form the adjacent terminal retainer recesses, the deformation of the ribs being thereby held down.

5 Claims, 6 Drawing Sheets

ELECTRICAL CONNECTOR FOR BOARDS AND METHOD OF MAKING

TECHNICAL FIELD

This invention relates to an electric connector for boards, fixed to a surface of a circuit board.

BACKGROUND ART

In recent years, the spread of personal computers has been remarkable. In a personal computer, a pair of electric connectors used for the board-to-board connection, and a pair of electric connectors used for the wire-to-board connection are provided.

For example, an electric connector fixed to an outer surface of a power board which controls a power source and an electric connector fixed to a mother board on which a CPU is mounted are connected together. One electric connector is a plug type connector having a connecting projection, while the other electric connector is a receptacle type connector having a connecting recess.

Conventionally, as a receptacle type electric connector of this kind (as disclosed in, for example, JP-A-11-067364), an electric connector having terminal retainer recesses opened in the connector-joining direction and formed in each of a pair of side walls which define a connecting recess has heretofore been provided.

With demands for the miniaturization and a higher function of a personal computer body, the electric connector of this kind has also demanded the miniaturization thereof and an increase in the number of electrodes thereof.

In general, the depth of the terminal retainer recesses between the electric connectors of this kind is set to 12 to 13 mm. In the meantime, it is demanded that the width of each of the terminal retainer recesses be set to, for example, around 0.4 mm, and that the intervals (pitch) at which the terminal retainer recesses are arranged be set to, for example, around 0.6 mm. In this electric connector, it is necessary that the thickness of each partition wall between adjacent terminal retainer recesses be set to, for example, as extremely small as 0.1 mm.

Therefore, in order to meet these demands in the connector disclosed in the above-mentioned JP-A-11-067364, the following new problems arise.

In a metal mold for molding a housing, it is necessary that terminal retaining recess-molding ribs be made thin (for example, 0.4 mm), and that the intervals of the ribs be set small (for example, 0.6 mm). However, when the terminal retainer recess-forming ribs are thus formed, there is a fear of deforming the ribs due to the pressure occurring during an injection molding operation. When the ribs are deformed during an injection molding operation, the thin partition walls (having a thickness of, for example, 0.1 mm) between the terminal retainer recesses are also deformed. In addition, the position accuracy of the terminal retainer recesses is deteriorated, and in its turn the position accuracy of the terminals decreases. As a result, the reliability of the electrical connection of the connectors lowers.

DISCLOSURE OF THE INVENTION

The present invention has been made in view of these problems, and aims at providing a miniaturized, highly reliable, electric connector for boards, capable of heightening the position accuracy of the terminals arranged at small intervals.

In order to attain this object, the present invention provides an electric connector for boards, including a housing of an insulating synthetic resin having a connecting recess opened in the connecting direction, and a plurality of terminals retained side by side by the housing, the housing including a pair of opposed side walls extending laterally so as to define the connecting recess therebetween, terminal retainer recesses penetrating through the respective side walls in the connecting direction, partition walls provided between adjacent terminal retainer recesses, and a plurality of openings formed in the portions of each of the partition walls, each opening corresponds to each partition wall, each opening making open to the exterior a pair of terminal retainer recesses opposed to each other via the partition wall opposed to the corresponding opening.

According to the present invention, pins for forming the openings in the outer side surface of the partition walls when the housing is injection molded in a metal mold are interposed between the adjacent terminal retainer recess-forming ribs in the metal mold. Therefore, during the injection molding operation, the deformation of the terminal retainer recess-forming ribs is held down, so that the position accuracy of the terminal retainer recesses (i.e. partition walls) arranged at small regular intervals can be heightened. In its return, a miniaturized, highly reliable, electric connector having a high position accuracy of the terminals can be provided.

It is preferable that the openings in the outer side surface of the sidewall be provided generally in an intermediate portion in the direction of the height of the side wall for the purpose of reliably suppressing the deformation of the terminal retainer recess-forming ribs during the injection molding operation.

Figure 1A:
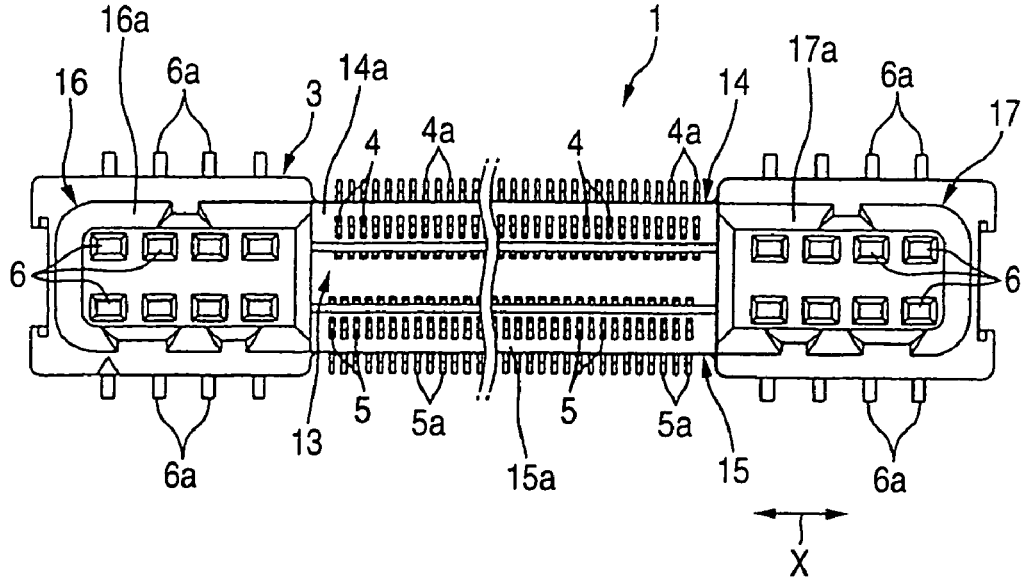
FIG. 1A is a plan view of the electric connector of a mode of embodiment of the present invention, and FIG. 1B a side view thereof.

Note that in the drawings, 1 denotes a (receptacle type) electric connector (electric connector for boards), 2 a circuit board, 2*a* an outer surface, 3 a housing, 3*a* a counter-surface, 4 and 5 terminals (for signals), 6 terminals (for a power source), 11 (plug type) electric connector, 12 a connecting projection, 13 a connecting recess, 14 and 15 side walls, 14*a* and 15*a* connecting-side end surfaces, 14*b* and 15*b* outer surfaces, 18 terminal retainer recesses, 19 a main body portion, 20 an elastically bent portion, 21 a projecting portion, 22 a contact, 23 a contact end portion, 25 openings, 26 partition walls, 30 a metal mold, 31 opening-forming pins, 32 terminal retainer recess-forming ribs, 40 opened portions, X a lateral direction, Y a connecting direction (a direction of the height), and Z a direction opposite to (the connecting direction).

BEST MODE FOR CARRYING OUT THE INVENTION

A preferred mode of embodiment of the present invention will now be described with reference to the attached drawings.

Figure 1B:
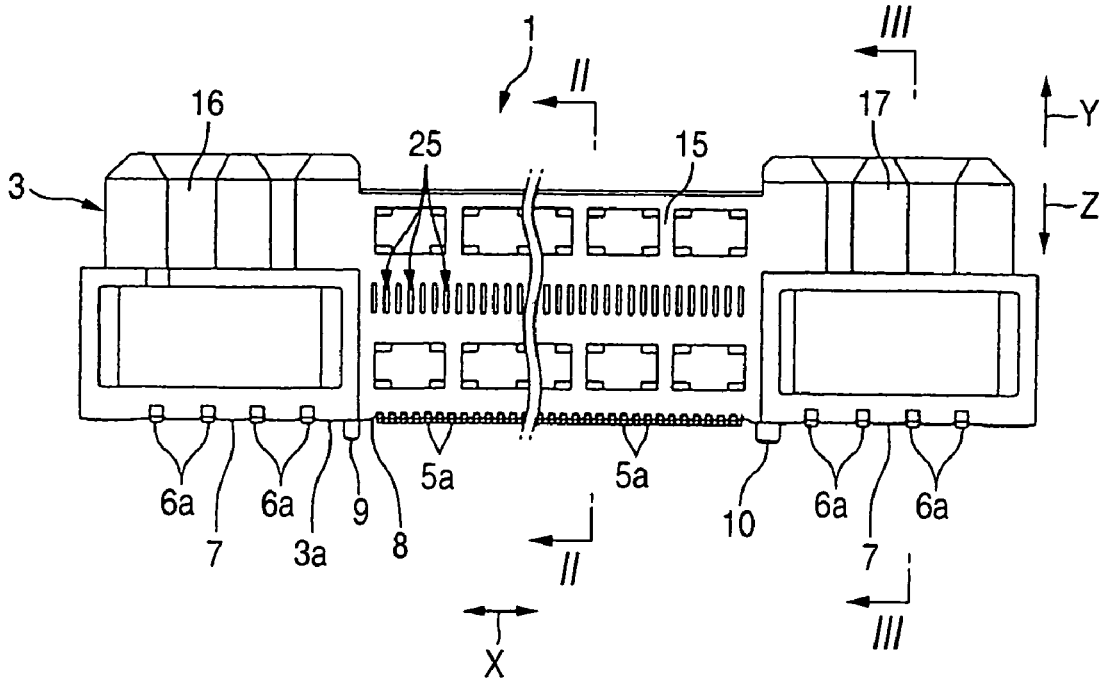
Figure 2:
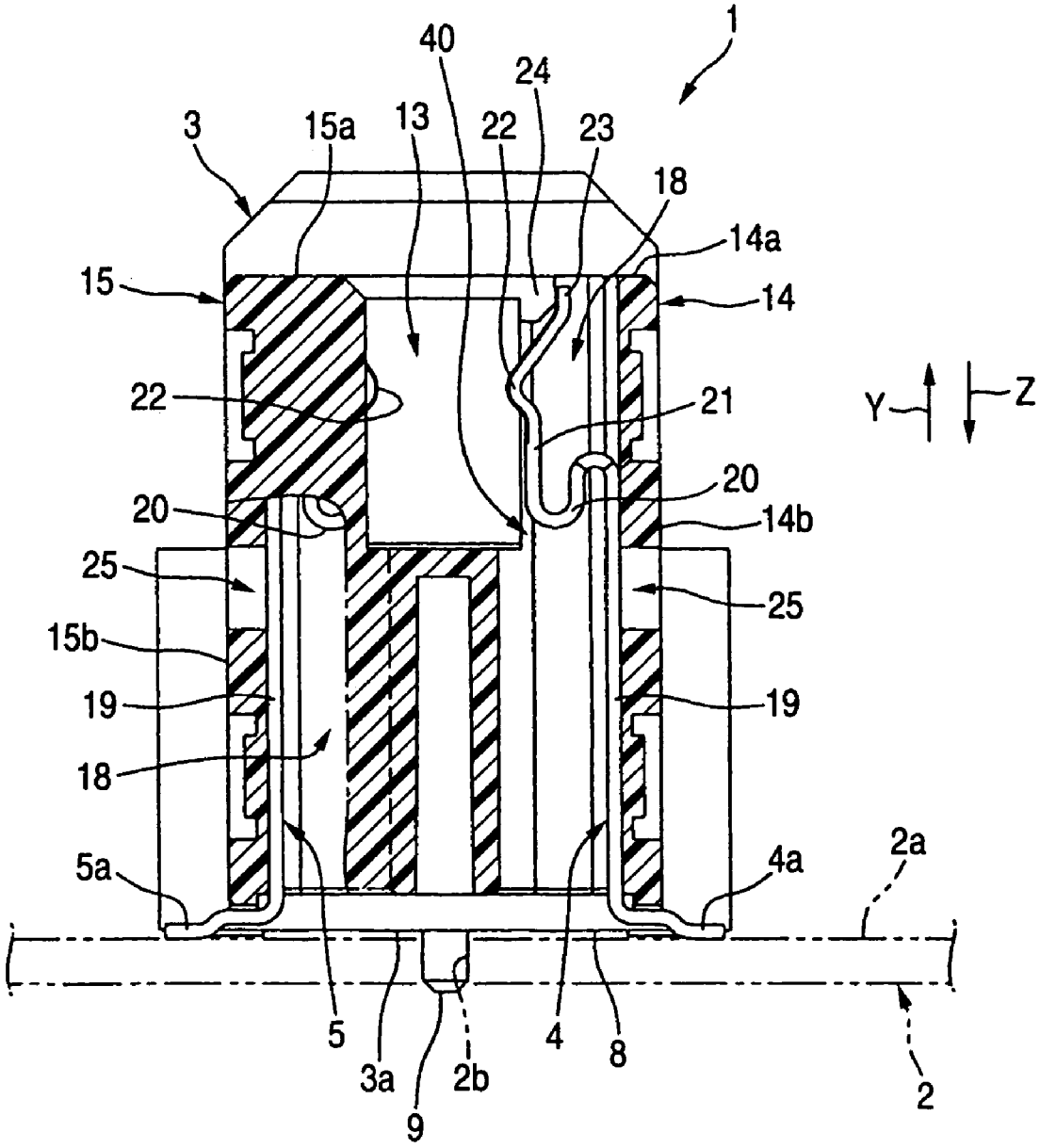
FIG. 2 is a sectional view taken along the line II—II in FIG. 1B.
Figure 3:
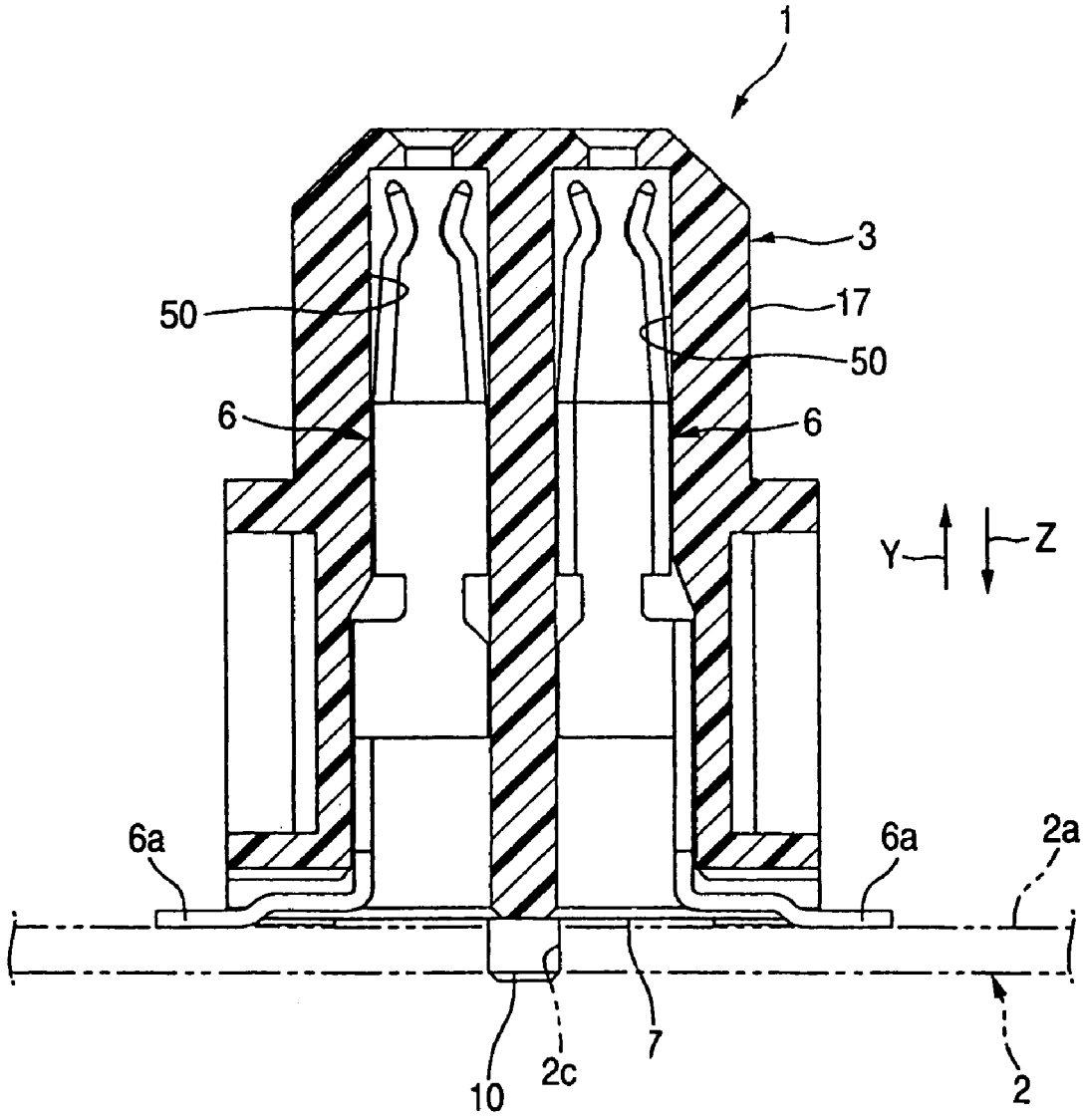
FIG. 3 is a sectional view taken along the line III—III in FIG. 1B.

FIG. 1A and FIG. 1B are plan view and a side view of a mode of embodiment of the electric connector for boards according to the present invention, FIG. 2 a sectional view taken along the line II—II in FIG. 1B, and FIG. 3 a sectional view taken along the line III—III in FIG. 1B.

Figure 4:
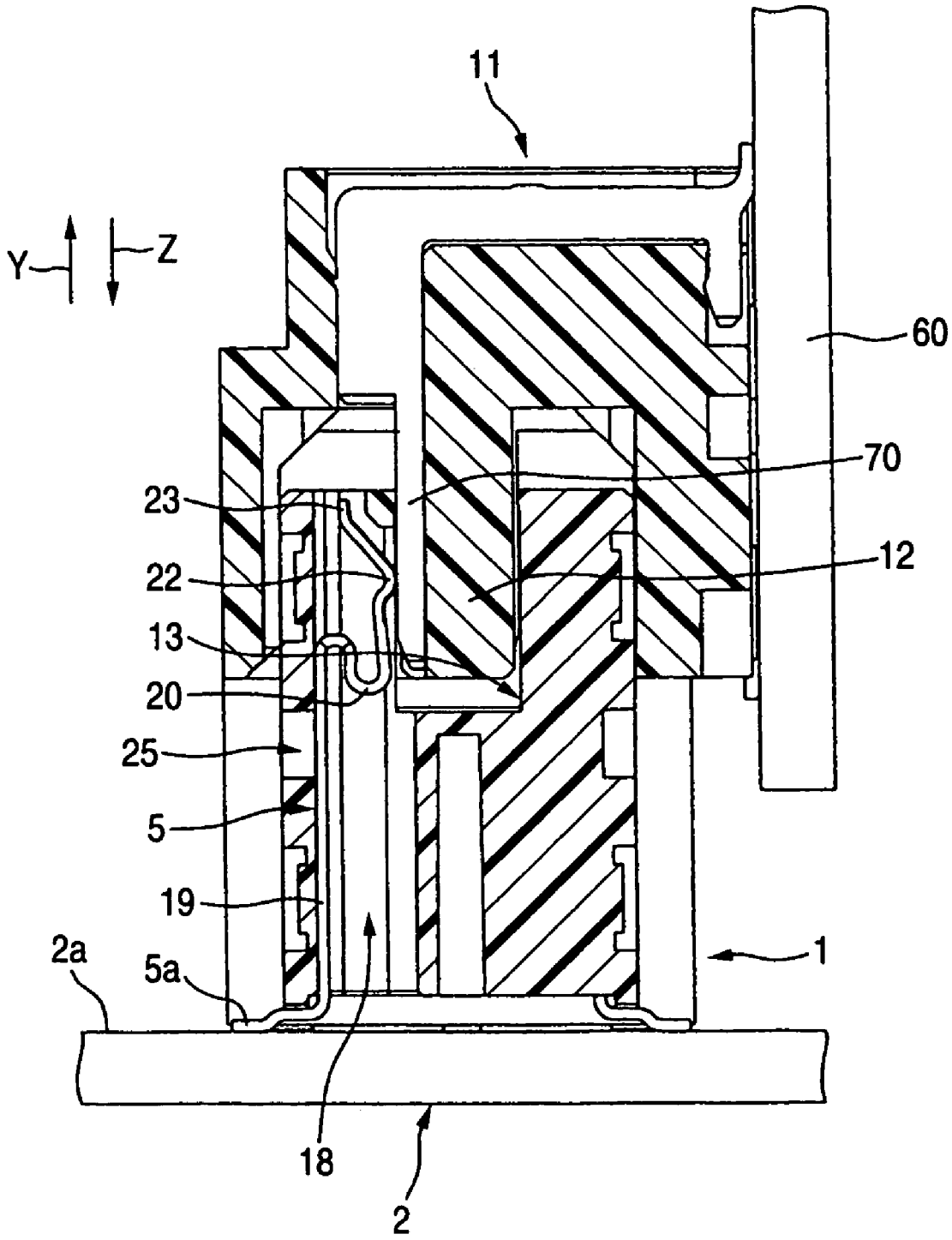
FIG. 4 is a schematic sectional view of the electric connector connected to an opposed plug type electric connector.

This electric connector 1 is a receptacle type electric connector. This mode of embodiment will be described on the basis of a case where the electric connector is used as one of a pair of board-to-board connecting electric connectors as shown in FIG. 4. This electric connector 1 can also be used as one of a pair of wire-to-board connecting electric connectors.

Referring to FIG. 2, the electric connector 1 is provided with a housing 3 fixed to a surface 2*a* of a circuit board 2 and made of an insulating synthetic resin, and a plurality of terminals for signals 4, 5 arranged in two lateral rows so that the terminals 4, 5 penetrate through the housing 3. Referring to FIG. 3, the electric connector 1 is provided with terminals 6 for a power source, arranged in two lateral rows so that the terminals 6 extend through the housing 3.

Referring to FIG. 1A and FIG. 1B, the housing 3 is long in the lateral direction X. Referring to FIG. 1B, the housing 3 has a counter-surface 3*a* opposed to the surface 2*a* of the circuit board 2 when the housing is fixed to the circuit board 2. The end portions opposed to each other in the lateral direction X of this counter-surface 3*a* are formed as a pair of fixing portions 7, 7 to be fixed to the surface 2*a* of the circuit board 2.

On the counter-surface 3*a*, an intermediate portion 8 between the two fixing portions 7, 7 is in a position offset upward from the fixing portions 7, and a clearance of a predetermined height is provided between the intermediate portion 8 and the surface 2*a* of the circuit board 2. Referring to FIG. 1A and FIG. 1B and FIG. 2, the leads 4*a*, 5*a* of the terminals 4, 5 project from the intermediate portion 8, extend sideways, and are soldered (not shown) to the surface 2*a* of the circuit board 2.

In the meantime, the leads 6*a* of the terminals 6 are held in the corresponding terminal retainer recesses 50 as shown in FIG. 3. As shown in FIG. 1A and FIG. 1B and FIG. 3, the leads 6*a* of the terminals 6 extend outward from side holes of the fixing portions 7, 7, and are soldered to conductive portions of the surface 2*a* of the circuit board 2.

As shown in FIG. 1B, a pair of locking members 9, 10 formed out of a synthetic resin integral with the housing 3 project in a boss-like state from the two fixing portions 7, 7. The locking members 9, 10 extend through corresponding locking recesses 2*b*, 2*c* in the circuit board 2 and locked therein as shown in FIG. 2 or FIG. 3. Each of the locking members 9, 10 are formed, for example, so as to have different diameter portions for thereby preventing the locking members from being fixed reversely to the circuit board 2.

Referring to FIG. 1A and FIG. 1B, the electric connector 1 is of a so-called top type, and the housing 3 thereof has the connecting recess 13 for inserting therein and connected thereto the connecting projection 12 of the plug type electric connector 11 shown in FIG. 4 and paired with the connector 1. The connecting recess 13 is opened in the connecting direction Y of the electric connector 1. The plug type electric connector 11 is of a so-called side type fixed to the opposed circuit board 60, and extending at its connecting projection 12 in parallel with the circuit board 60. However, the plug type electric connector 11 may also be of a so-called top type. Referring to FIG. 4, to the terminal 5 in a connected state, the terminal 70 opposed thereto of the plug type electric connector 11 is connected.

Referring to FIG. 1A, the connecting recess 13 is defined by a pair of opposed side walls 14, 15 and a pair of opposed end walls 16, 17, all of which are provided in the housing 3, and has a rectangular shape.

Referring to FIG. 2, each of the side walls 14, 15 is provided with a plurality of terminal retainer recesses 18 arranged side by side (in the lateral direction X in FIG. 1) and penetrating through the side walls 14, 15 in the connecting direction Y.

The terminal retainer recesses 18 are opened in the connecting side end surfaces 14*a*, 15*a*, and extend in the direction Z contrary to the connecting direction Y, the retainer recesses 18 being thereby opened in the above-mentioned counter surface 3*a* as well.

Referring to FIG. 2, the terminal 4 is provided with an elongated main body 19 press-fitted and locked in a terminal retainer recess 18, a projecting portion 21 extending from an upper end of the main body 19 via an S-shaped elastically bent portion 20 in the connecting direction Y, a contact 22 made of a mountain-shaped projection formed in the projecting portion 21, a contact end portion 23 extending diagonally from the contact 22, and a lead 4*a* extending outward in a bent state from a lower end of the main body 19.

The terminal retainer recess 18 is opened to the connecting recess 13 through the opened portion 40. Since the projecting portion 21 is elastically urged toward the connecting recess 13 by the elastically bent portion 20, the contact 22 enters the interior of the connecting recess 13 through the opened portion 40. Since the contact end portion 23 engages a stopper 24 provided on an end portion of the corresponding side wall 14, the quantity of projection of the contact 22 toward the connecting recess 13 is restricted.

As shown in FIG. 4, the terminal 5 also has the same construction as the terminal 4.

Referring to FIG. 1B and FIG. 2, the outer side surfaces 14*b*, 15*b* of the side walls 14, 15, a plurality of vertically long openings 25 are formed side by side (in a row in the lateral direction X). The opening 25 is provided generally in an intermediate portion in the direction of the height (i.e. in the connecting direction Y) of each of the side walls 14, 15.

The side wall 14 and the side wall 15 have the same construction. The side wall 14 has partition walls 26 separating the adjacent terminal retainer recesses 18 from each other. The openings 25 are formed in the outer side surface 14*b* of the side wall, and the openings 25 are opposed to the relative partition walls 26. Further, the openings 25 are formed by cutting out the parts of the side wall. The opening communicates with the terminal retainer recesses 18 on both sides via a pair of communication portions 25*a* (in FIG. 5, one communication portion 25*a* only is shown). As a result, each opening 25 makes a pair of terminal retainer recesses 18, 18 open to the exterior of the housing 3 respectively, wherein the pair of terminal retainer recesses 18, 18 are opposed to each other via the partition walls 26 opposed to the opening 25.

Figure 5:
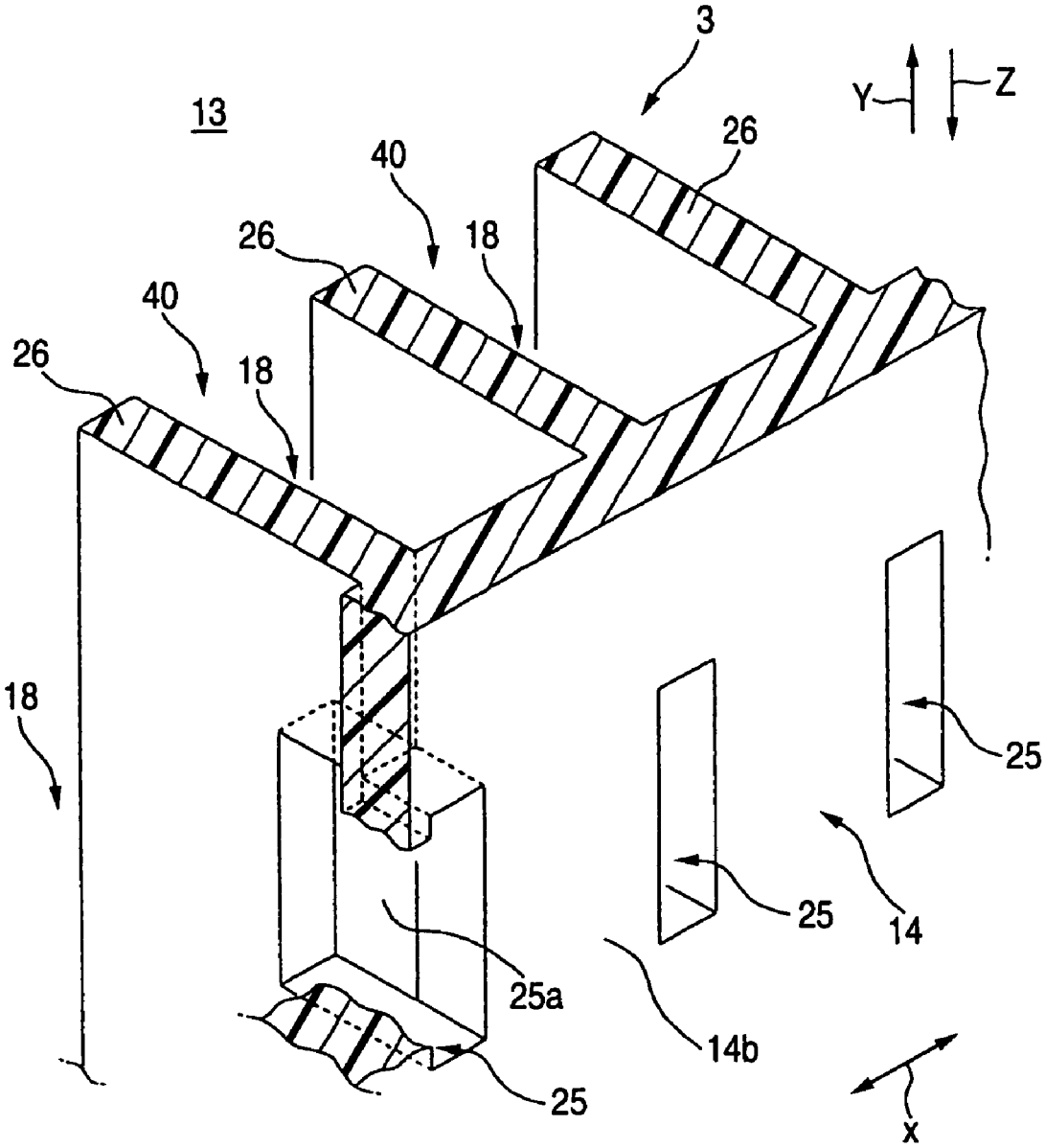
FIG. 5 is a partially cutaway view in enlarged perspective of a side wall of the electric connector.
Figure 6:
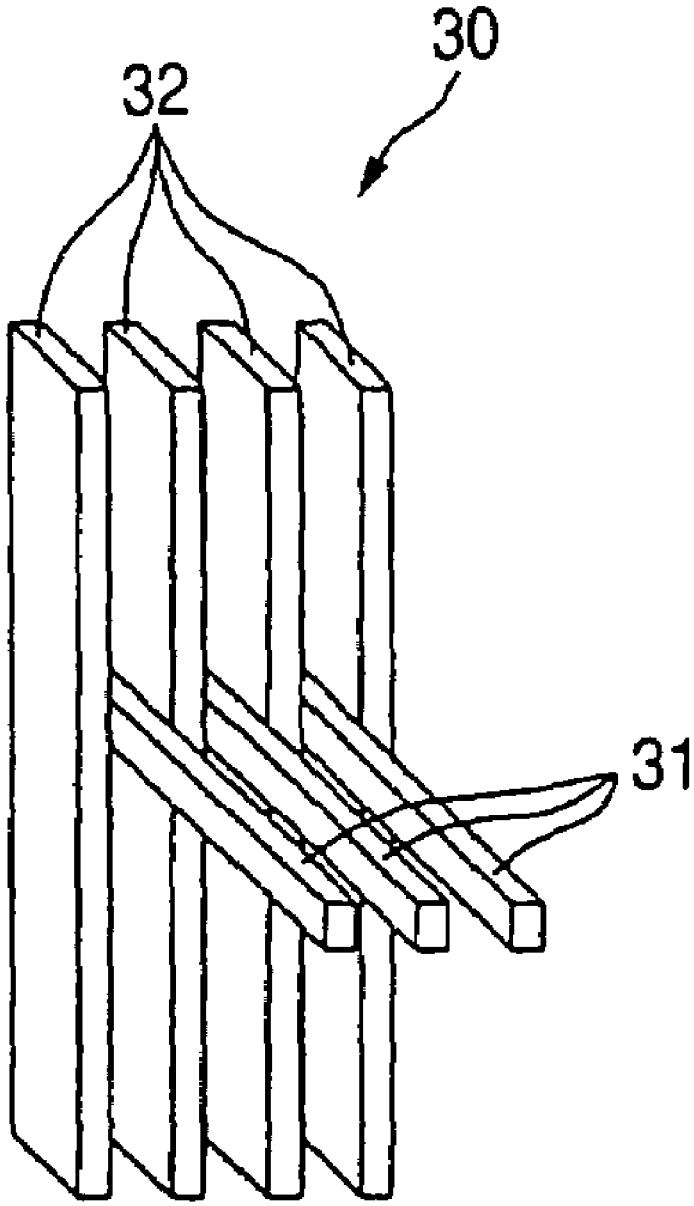
FIG. 6 is a schematic perspective view showing the construction of a metal mold.

FIG. 6 is a schematic drawing showing the part of a metal mold which is used to injection mold the portion shown in FIG. 5 of the housing 3. In the metal mold 30, pins 31 for forming the openings 25 are interposed among the ribs 32 of the metal mold 30 for forming the adjacent terminal retainer recesses during an injection molding operation. Therefore, the deformation of the ribs 32 for forming the terminal retainer holes during an injection molding operation is held down. This enables the position accuracy of the terminal retainer recesses 18 arranged at small intervals and partition walls 26 to be heightened, and in its turn the position accuracy of the terminals 4, 5 to be also heightened. Thus, a miniaturized, highly reliable, electric connector 1 can be provided.

Especially, since the openings 25 are provided in the portions of the side walls 14, 15 which generally correspond to intermediate sections in the direction of the height (i.e. in the connecting direction Y) of each of the side wall 14, 15, the deformation of the ribs 32 for forming the terminal retainer holes during an injection molding operation can be reliably prevented.

The present invention is not limited to the above-described mode of embodiment but can be modified variously within the scope thereof.

INDUSTRIAL APPLICABILITY

When the housing is injection molded in the metal mold in the present invention, the pins for forming the openings in the outer side surface of the partition walls come to be interposed among the ribs of the metal mold for forming the adjacent terminal retainer recesses. Therefore, since the deformation of the terminal retainer recess-forming ribs can be held down during an injection molding operation, the position accuracy of the terminal retainer recesses (partition walls) arranged at small intervals can be heightened, and in its turn the position accuracy of the terminals can also be heightened. This enables a miniaturized, highly reliable, electric connector to be provided.

The invention claimed is:

1. An electric connector for boards, comprising:

a housing, made of an insulating synthetic resin, including a connecting recess opened in a connecting direction; and plural terminals retained laterally arranged in the housing, wherein the housing further includes:

a pair of opposed side walls extending laterally so as to define a connecting recess therebetween, plural terminal retainer recesses penetrating through respective side walls in the connecting direction, plural partition walls for separating the adjacent terminal retainer recesses from each other, and plural openings formed in outer side surfaces of both of the pair of opposed side walls, corresponding to respective partition walls, wherein, through each opening of the plural openings, a pair of the terminal retainer recesses adjacent to each other via one of the partition walls corresponding to the opening are opened to the exterior of housing.

2. The electric connector for boards according to claim 1, wherein the openings of the outer side surfaces of the side walls are arranged substantially in the vertically intermediate portions of the side walls.

3. A metal mold of injection molding, for forming a housing of an electric connector for boards, wherein the housing has plural terminal retainer recesses penetrating through the housing in a connecting direction, comprising:

plural terminal retainer recess-forming ribs for forming the plural terminal retainer recesses; and plural opening-forming pins, each interposing between a pair of adjacent terminal retainer recess-forming ribs, for forming openings in a pair of opposed side walls of the housing, wherein, through each opening of the openings, a pair of the terminal retainer recesses adjacent to each other via a partition wall corresponding to the opening are opened to an exterior of housing.

4. The metal mold of injection molding according to claim 3, wherein the opening-forming pins are arranged substantially at the vertically intermediate portions of the side walls of the housing.

5. A method of forming a housing of an electric connector for boards, wherein the housing has plural terminal recesses penetrating through the housing in the connecting direction, comprising:

injecting synthetic resin to a metal mold, wherein the metal mold comprises plural terminal retainer recess-forming ribs for forming the plural terminal retainer recesses, and opening-forming pins, each interposing between a pair of adjacent terminal retainer recess-forming ribs, for forming openings in a pair of opposed side walls of the housing; and removing the opening-forming-pins wherein, through each opening of the openings, a pair of the terminal retainer recesses adjacent to each other via a partition wall corresponding to the opening are opened to an exterior of housing.

* * * * *